US007410739B2

(12) United States Patent
Nakamura et al.

(10) Patent No.: US 7,410,739 B2
(45) Date of Patent: Aug. 12, 2008

(54) COLOR IMAGE FORMING DEVELOPER, COLOR IMAGE FORMING METHOD, AND COLOR IMAGE FORMING DEVICE

(75) Inventors: Yasushige Nakamura, Ebina (JP); Satoshi Takezawa, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 557 days.

(21) Appl. No.: 10/932,109

(22) Filed: Sep. 2, 2004

(65) Prior Publication Data

US 2005/0208397 A1 Sep. 22, 2005

(30) Foreign Application Priority Data

Mar. 19, 2004 (JP) ..... 2004-081359

(51) Int. Cl.
*G03G 9/08* (2006.01)

(52) U.S. Cl. ..... 430/107.1; 430/45.51; 430/108.21

(58) Field of Classification Search ..... 430/45.51, 430/107.1, 108.21, 124.4, 47.2; 399/223, 399/308, 336
See application file for complete search history.

(56) References Cited

U.S. PATENT DOCUMENTS

| | | | | |
|---|---|---|---|---|
| 4,699,863 | A | 10/1987 | Sawatari et al. | |
| 5,432,035 | A | 7/1995 | Katagiri et al. | |
| 5,582,950 | A | 12/1996 | Katagiri et al. | |
| 6,136,488 | A | 10/2000 | Kushino et al. | |
| 2003/0134214 | A1 | 7/2003 | Nakamura et al. | |
| 2003/0186148 | A1 | 10/2003 | Nakamura et al. | |
| 2003/0190537 | A1 | 10/2003 | Nakamura et al. | |
| 2003/0203304 | A1 * | 10/2003 | Katagiri et al. | 430/124 |
| 2004/0142263 | A1 | 7/2004 | Mikuriya et al. | |

FOREIGN PATENT DOCUMENTS

| | | | |
|---|---|---|---|
| EP | 1 319 993 | A1 | 6/2003 |
| JP | A 58-102247 | | 6/1983 |
| JP | A 58-102248 | | 6/1983 |
| JP | A 60-57857 | | 4/1985 |
| JP | A 60-57858 | | 4/1985 |
| JP | A 60-63545 | | 4/1985 |
| JP | A 60-63546 | | 4/1985 |
| JP | A 60-131544 | | 7/1985 |
| JP | A 60-133460 | | 7/1985 |
| JP | A 61-132959 | | 6/1986 |
| JP | A 6-348056 | | 12/1994 |
| JP | A 7-191492 | | 7/1995 |
| JP | A 10-39535 | | 2/1998 |
| JP | A 11-38666 | | 2/1999 |
| JP | A 11-38667 | | 2/1999 |
| JP | A 11-65167 | | 3/1999 |
| JP | A 11-125928 | | 5/1999 |
| JP | A 11-125929 | | 5/1999 |
| JP | A 11-125930 | | 5/1999 |
| JP | A 2000-35689 | | 2/2000 |
| JP | A 2000-147824 | | 5/2000 |
| JP | A 2000-155439 | | 6/2000 |
| JP | 2003-186246 | A | 7/2003 |
| JP | 2003-270842 | A | 9/2003 |
| JP | 2003-270860 | A | 9/2003 |
| JP | 2003-295496 | A | 10/2003 |
| JP | 2004-170957 | A | 6/2004 |

OTHER PUBLICATIONS

Diamond, A.S. et al., ed., *Handbook of Imaging Materials*, second edition, Marcel Dekker, Inc., NY (2002), pp. 147, 148, and 164-168.*
English-language translation of Japanese Office Action mailed on May 1, 2008.

* cited by examiner

*Primary Examiner*—Janis L Dote
(74) *Attorney, Agent, or Firm*—Oliff & Berridge, PLC

(57) ABSTRACT

The present invention provides a color image forming developer comprising yellow, magenta, and cyan toners each containing an infrared absorber, wherein the cyan toner has a maximum infrared absorbance in the infrared region lower than that of the magenta toner and that of the yellow toner, to simultaneously attain sufficient fixation capacity and sufficient resistance to void formation, and also provides an improved image forming method and an image forming device using the developer.

6 Claims, 2 Drawing Sheets

COLOR IMAGE FORMING DEVELOPER, COLOR IMAGE FORMING METHOD, AND COLOR IMAGE FORMING DEVICE

BACKGROUND OF THE INVENTION

1. Field of the Invention

The present invention relates to a photo-fixed color image forming developer used in electrophotography, electrostatic recording, and magnetic recording, and to a color image forming method and a color image forming device using the same.

2. Description of the Prior Art

Generally, in electrophotography, which is widely employed in copiers and printers, a photoconductive insulator surface in a photoreceptor drum is electrified with uniform static charges, which may be positive or negative. A charged photoconductive insulator surface is then irradiated with light to form a latent image by means of partially erasing the static charges on the surface. For example, a latent image produced as a result of image information can be formed on a charged photoconductive insulator surface by irradiating the surface with laser beams in response to image information to erase the surface charges hit by the beams. Then, a toner in a developer assuming the form of fine particles is deposited onto the latent image charged on the surface, to thereby visualize the image. The toner image is formed on the photoconductive insulator surface. The resultant toner image is then electrostatically transferred onto a recording medium, such as paper.

The transferred toner image is fixed on the recording medium, where the toner is molten when transferred onto the medium, and then solidified/fixed on the surface. The toner is rendered molten by means of elevated pressure and/or temperature, or by the aid of light. Flash fusing has been attracting attention, because it is free of problems caused by elevated pressure or temperature.

Flash fusing generally has the following advantages: (i) deterioration of image resolution (repeatability) is lowered, because fixing the toner does not require pressurization of the toner, and therefore the toner does not have to come into contact with and receive pressure from a fuser roller; (ii) printing can be started as soon as the power source is switched on, unlike the case of conventional technique, which involves a time delay before a heat source (a fuser roller or the like) is preheated to a desired temperature level; (iii) provision of a high-temperature heat source is not necessary, and therefore the device does not undergo a substantial temperature rise; and (iv) there is avoided the situation where paper is ignited by heat from a heat source when jammed in the fuser device while the system is down.

In spite of these advantages, flash fusing involves a problem of insufficient fixation capacity when a color toner is used, because a color toner, which has lower light-absorbing capacity than a black toner, may fail to absorb sufficient light to convert its energy into heat, resulting in insufficient melting in the fixation step. Various attempts have been made to improve fixation capacity by means of incorporating into a toner an infrared absorber serving as a light absorber, as disclosed by a number of patent documents; e.g., Japanese Patent Laid-Open Publication Nos. 60-63545, 60-63546, 60-57858, 60-57857, 58-102248, 58-102247, 60-131544, 60-133460, 61-132959, 2000-147824, Hei 7-191492, 2000-155439, Hei 6-348056, Hei 10-39535, 2000-35689, Hei 11-38666, Hei 11-125930, Hei 11-125928, Hei 11-125929, and Hei 11-65167. These patent documents disclose techniques for incorporating into a toner an agent capable of absorbing light in the infrared region, serving as an infrared absorber, to improve flash fusing capacity, thereby solving problems resulting from insufficient melting capacity. In addition to use of the absorber, increasing emission capacity of a photo-fixer is another technique for improving fixation capacity of a toner.

Although exhibiting improved fixation capacity, a toner containing an excessive quantity of infrared absorber, generates excessive heat as a result of absorbing an excessive quantity of light, thereby causing printing defects referred to as "voids" that are left by the toner, moisture in the medium, or the like. Therefore, infrared absorber content of toner must be determined in view of its color, in order to simultaneously attain sufficient resistance to void formation and sufficient fixation capacity.

However, some of the color image forming developers proposed by the above patent documents comprise cyan, magenta, and yellow toners that contain an infrared absorber, and encounter difficulty in simultaneously attaining sufficient resistance to void formation and sufficient fixation capacity during the fixation step.

As a result of conducting extensive studies, the present inventors have found that the above problems result from a cyan pigment in a cyan toner having higher capacity of absorbing visible light in a wavelength range of 600 to 800 nm as compared with magenta and yellow toners. When the same infrared absorber in incorporated into the respective toners at the same content, total quantity of light absorbed varies according to visible ray absorbing capacity. This makes it difficult to simultaneously attain sufficient fixation capacity and sufficient resistance to void formation.

When emission intensity during the fixation step is increased in accordance with flash fusing capacity of magenta and yellow toners, although these toners exhibit good fixation capacity, resistance of the cyan toner to void formation may deteriorate, because the cyan toner can absorb excessive visible light to thereby form voids. Meanwhile, when emission intensity during the fixation step is lowered to an extent to avoid formation of voids by the cyan toner, although the cyan toner exhibits sufficient fixation capacity, sufficient fixation capacity of the magenta and yellow toners cannot be secured, because the magenta and yellow toners, which have lower visible light absorbing capacity than a cyan toner, cannot absorb sufficient light to melt sufficiently. Therefore, sufficient fixation capacity and sufficient resistance to void formation cannot be attained simultaneously when emission intensity is set in accordance with these properties for a cyan toner or magenta/yellow toners, the former having higher visible light absorption capacity than the latter.

SUMMARY OF THE INVENTION

Accordingly, it is an advantage of the present invention to provide a color image forming developer in which advantageous in that each of a plurality of color toners can simultaneously attain sufficient fixation capacity and sufficient resistance to void formation. It is another advantage of the present invention to provide a color image forming method using the developer. It is still another advantage of the present invention to provide an image forming device using the developer.

The color image forming developer of the present invention comprises yellow, magenta, and cyan toners each containing an infrared absorber, wherein the cyan toner has a maximum infrared absorbance in a wavelength range of 800 to 1100 nm lower than that of the magenta toner and that of the yellow toner.

The color image forming method of the present invention comprises a step for forming an electrostatic latent image on a surface of an electrostatic latent image holding member, a step for developing the image with a toner-containing developer to thereby form a toner image, a step for transferring the toner image formed on the electrostatic latent image holding member onto a surface of a transferring material, and a step for fixing the toner image transferred on the transferring material onto a surface of a recording medium, wherein the developing step employs a developer which comprises yellow, magenta, and cyan toners each containing an infrared absorber, the cyan toner having a maximum infrared absorbance in a wavelength range of 800 to 1100 nm lower than that of the magenta toner and that of the yellow toner.

The color image forming device of the present invention uses a color toner which comprises yellow, magenta, and cyan toners each containing an infrared absorber, wherein the cyan toner has a maximum infrared absorbance in a wavelength range of 800 to 1100 nm lower than that of the magenta toner and that of the yellow toner.

BRIEF DESCRIPTION OF THE DRAWINGS

Preferred embodiments of the present invention will be described in detail based on the following figures, wherein.

DESCRIPTION OF THE PREFERRED EMBODIMENTS

Figure 1:
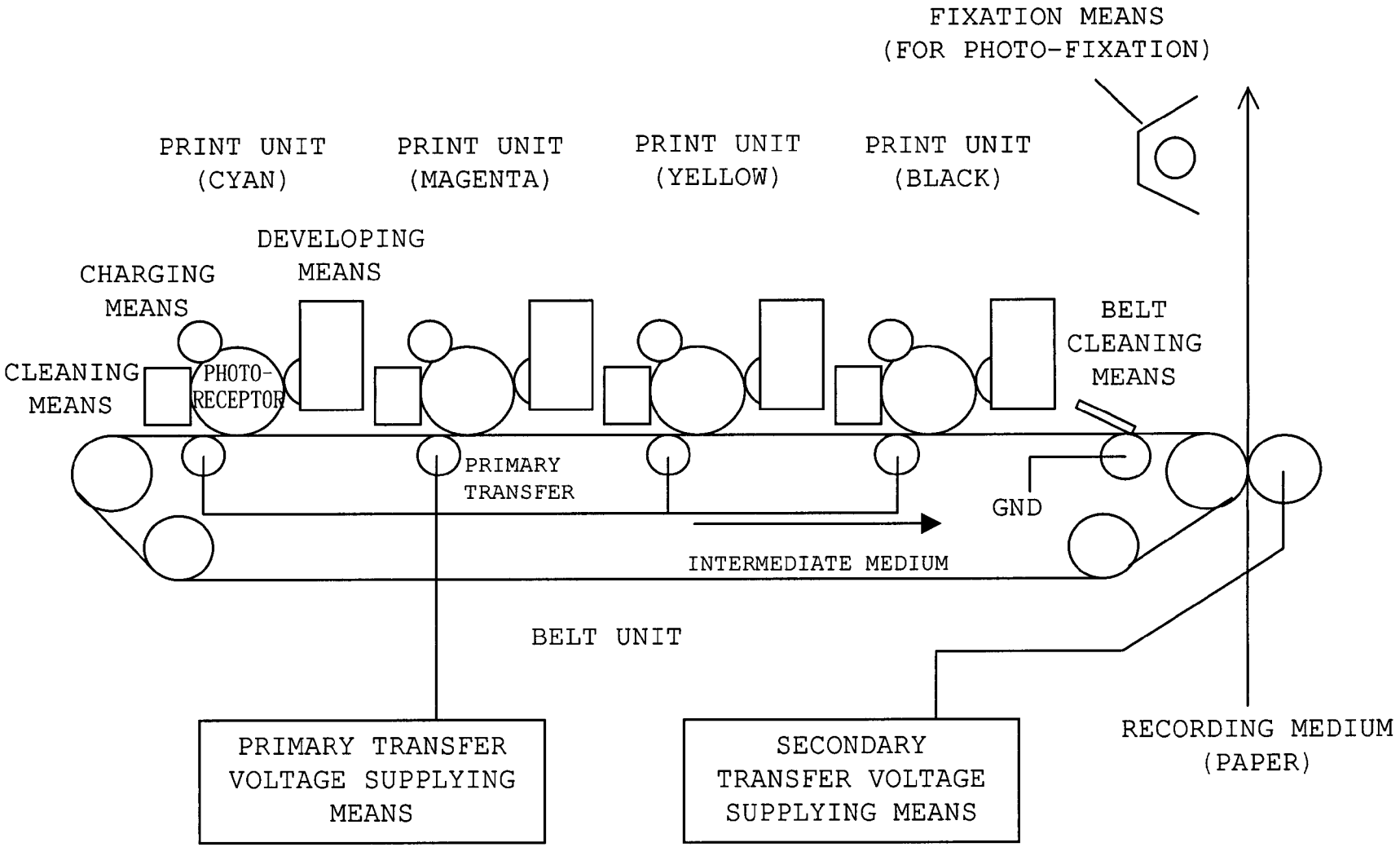
FIG. 1 is a schematic diagram of an image forming device of an embodiment of the present invention.

Embodiments for carrying out the present invention will now be described. The following embodiments are understood to merely aid in the understanding of the invention and are not intended to limit the invention thereto.

As the light absorption capacity of a pigment approaches the infrared region, efficiency in converting absorbed light into heat generally increases, and hence temperature increases as well. A cyan pigment exhibits an absorption peak in a wavelength range of 600 to 750 nm, magenta pigment exhibits an absorption peak in a wavelength range of 500 to 600 nm, and yellow pigment in a region of 450 nm and below. Therefore, when these pigments are irradiated with the same quantity of light, the cyan pigment generates more heat than do the others. After conducting extensive studies, the present inventors have found that difficulty in simultaneously attaining sufficient resistance to void formation and sufficient fixation capacity results from a cyan pigment in a cyan toner having higher capacity of absorbing visible light in a wavelength range of 600 to 800 nm than a magenta toner and a yellow toner. In other words, when the same infrared absorber in incorporated into the respective toners at the same content, total quantity of light absorbed varies with infrared ray absorbing capacity of respective toners, thereby raising the above difficulty.

The inventors have solved the above difficulty in simultaneously attaining improved fixation capacity and improved resistance to void formation, by means of limiting maximum infrared absorbance of a cyan toner in a wavelength range of 800 to 1100 nm to a value lower than that of a magenta toner and that of a yellow toner. Preferably, the quantity of absorbed infrared ray in a wavelength range of 800 to 1100 nm is maintained smaller in the cyan toner than in the magenta and yellow toners, in view of the above difference. In this case, decreased quantity of infrared rays of 800 to 1100 nm absorbed by the cyan toner can be compensated by increased quantity of absorbed visible rays of 600 to 800 nm. As a result, the sum of quantities of absorbed visible and infrared rays in a wavelength range of 600 to 1100 nm in the respective toners equal, and the color toner containing cyan, magenta and yellow toners can simultaneously attain sufficient fixation capacity and sufficient resistance to void formation.

In other words, by means of maintaining the total quantity of visible and infrared rays in a wavelength range of 600 to 1100 nm absorbed by a cyan toner essentially equivalent to that absorbed by yellow toner and/or that absorbed by magenta toner, the cyan toner can simultaneously attain sufficient fixation capacity and sufficient resistance to void formation. This is possible because emission intensity of the photo-fixer is determined in view of simultaneously attaining sufficient fixation capacity and sufficient resistance to void formation with respect to one of the toners. In this case, lowering of fixation capacity and resistance to void formation of the other toners can be prevented, thereby preventing deterioration of these properties.

When an infrared absorber having the same infrared absorption capacity is used for cyan, magenta, and yellow toners, each toner can have an equivalent fixation level, by means of incorporating the infrared absorber in a cyan toner at a lower content than in a yellow or magenta toner.

Attaining improved balance between fixation capacity and resistance to void formation may be difficult when an infrared absorber is incorporated at the same content into cyan, magenta, and yellow toners.

Therefore, the infrared absorber is preferably incorporated into the respective color toners within the following ranges of content ratios:

$$0.3<Kc/Km<0.9 \quad (1)$$

$$0.3<Kc/Ky<0.9 \quad (2)$$

wherein,

Kc: Content of an infrared absorber in a cyan toner, in parts by weight per 100 parts by weight of the toner Km: Content of an infrared absorber in a magenta toner, in parts by weight per 100 parts by weight of the toner Ky: Content of an infrared absorber in a yellow toner, in parts by weight per 100 parts by weight of the toner When a Kc/Km ratio or a Kc/Ky ratio falls below 0.3, a cyan toner may have a lower fixation capacity than a magenta or yellow toner, when fixed at the same magnitude of flash energy. Meanwhile, when the Kc/Km ratio or the Kc/Ky ratio falls above 0.9, a cyan toner may absorb excessive heat, resulting in formation of voids therein. Kc is preferably 0.05 to 5 parts by weight per 100 parts by weight of the toner, more preferably 0.1 to 2 parts, still more preferably 0.15 to 0.5 parts. Km and Ky are preferably 0.1 to 5 parts by weight per 100 parts by weight of the toner, more preferably 0.2 to 2 parts, still more preferably 0.4 to 1 part. When any of the above values exceeds 5 parts by weight, a full-color image may be difficult to form, because of darkened color tone.

Examples of infrared absorbers useful for the present invention include those having at least one strong light absorption peak within the infrared range of 800 to 1100 nm. The absorbers may be organic or inorganic. More specifically, inorganic infrared absorbers that can be used include, but are not limited to, lanthanoid compounds such as ytterbium oxide, ytterbium phosphate, indium tin oxide, and tin oxide. Organic infrared absorbers that can be used include, but are not limited to, aminium compounds, diimonium compounds, naphthalocyanine-based compounds, cyanine-based compounds, polymethine-based compounds, and polyazo compounds. These may be used either individually or in combination. When these absorbers are used in combination, the toner will exhibit improved fixation capacity. Preferable combinations are a naphthalocyanine derivative, and an aminium and/or diimonium compound.

Binder resins useful for the present invention include the following. Preferable main binder resins include polyesters and cyclo-olefins. Other preferable resins include copolymers of styrene, and an acryl or methacryl compound; polyvinyl chloride; phenolic resin; acrylic resin; methacrylic resin; polyvinyl acetate; silicone resin; polyester resin; polyurethane; polyamide resin; furan resin; epoxy resin; xylene resin; polyvinyl butyral; terpene resin; coumarone/indene resin; petroleum-based resin; and polyether polyol. These may be used either individually or in combination.

The toner of the present invention may further incorporate fine, white, inorganic particles serving as a flow improver or the like, in am amount of 0.01 to 5 parts by weight per 100 parts per weight of toner, preferably 0.01 to 2 parts. Fine, inorganic particles that can be used in the present invention include those of silica, alumina, titanium oxide, barium titanate, magnesium titanate, calcium titanate, strontium titanate, zinc oxide, silica sand, clay, mica, wollastonite, diatomaceous earth, chromium oxide, cerium oxide, colcothar, antimony trioxide, magnesium oxide, zirconium oxide, barium sulfate, barium carbonate, calcium carbonate, silicon carbide, and silicon nitride, among which silica is particularly preferable. Fine particles of silica, titanium, resin, alumina, and the like may be used in combination. Fine particles of metallic salts of higher fatty acids, represented by zinc stearate, and fluorine-based high-molecular-weight compounds may be incorporated as cleaning active agents.

No particular limitations are imposed on colorants for cyan, magenta, and yellow toners. Colorants that can be used for yellow toners include compounds represented by condensed azo compounds, isoindolinone compounds, anthraquinone compounds, azo metal complexes, methane compounds, and allyl amide compounds. More specifically, those suitably used include C.I. Pigments Yellow 12, 13, 14, 15, 17, 62, 74, 83, 93, 94, 95, 109, 110, 111, 128, 129, 147, 168, 180, and 185, among which C.I. Pigments Yellow 180 and 185 are particularly preferred, in consideration of color tone of the images.

Colorants that can be used for cyan toners include copper phthalocyanine compounds and their derivatives; anthraquinone compounds; and lake compounds serving as basic dyes. More specifically, those particularly suitable include C.I. Pigments Blue 1, 7, 15, 15:1, 15:2, 15:3, 15:4, 60, 62 and 66, among which C.I. Pigments Blue 15 and 15:3 are particularly preferred, in consideration of color tone of the images. Suitable colorants for magenta toners include β- and γ-type unsubstituted quinacridones of the following structures. In addition to these, various types of pigments and dyes can also be used. These include condensed azo compounds, diketopyrrolopyrrole compounds, anthraquinone, quinacridone compounds, lake compounds serving as basic dyes, naphthol compounds, benzimidazole compounds, thioindigo compounds, and perylene compounds. More specifically, preferable examples include C.I. Pigments Red 2, 3, 5, 6, 7, 23, 48:2, 48:3, 48:4, 57:1, 81:1, 122, 144, 146, 166, 169, 177, 184, 185, 202, 206, 220, 221, 238, 254, and 269. When monochrome toners are used, preferable examples include carbon black, lampblack, iron black, ultramarine blue, nigrosine dye, and aniline blue.

Antistatic agents which can be used in the present invention include calixarenes, nigrosine-based dyes, quaternary ammonium salts, amino-containing polymers, metal-containing azo dyes, complex compounds of salicylic acid, phenol compounds, azochromium-based compounds, and azozinc-based compounds.

Moreover, magnetic toners, incorporated with a magnetic material such as powdered iron, magnetite or ferrite, can be also used in the present invention. In the case of a color toner, in particular, white magnetic powder can be used.

Most preferable waxes for the toner of the present invention include ester wax, and polyethylene, polypropylene or polyethylene/propylene copolymer. Other waxes useful for the present invention include polyglycerin wax, microcrystalline wax, paraffin wax, carnauba wax, Sasol wax, montanic acid ester wax, and deoxygenated carnauba wax; unsaturated fatty acids such as palmitic, stearic, montanic, frangin acid, eleostearic, and parinaric acid; saturated alcohols such as long-chain alkyl alcohols (e.g., stearyl alcohol, aralkylalcohol, behenylalcohol, carnaubyl alcohol, ceryl alcohol, and melissyl alcohol, and other alcohols having a long alkyl chain); polyhydric alcohols such as sorbitol; fatty acid bisamides such as linolic acid amide, oleic acid amide, and lauric acid amide; saturated fatty acid amides such as methylene bisstearic acid amide, ethylene biscapric acid amide, ethylene bislauric acid amide, and hexamethylene bisstearic acid amide; unsaturated fatty acid amides such as ethylene bisoleic acid, hexamethylene bisoleic acid, N,N'-dioleyladipic acid, and N,N'-dioleylcebacic acid amide; aromatic bisamides such as m-xylenebisstearic acid amide and N,N'-distearylisophthalic acid amide; metallic salts of fatty acids such as calcium stearate, calcium laurate, zinc stearate, and magnesium stearate (which are commonly referred to as metallic soaps); waxes of aliphatic hydocarbon waxes grafted with a vinyl-based monomer such as styrene or acrylic acid; partially esterified products of fatty acid (e.g., behenic acid monoglyceride) and polyhydric alcohol; and methyl esters of vegetable oil hydrogenated to have a hydroxyl group. Wax for the toner preferably has a DSC-determined endothermic peak in a temperature range of 50 to 90° C. A toner component may be blocked when such a peak appears below 50° C., and the toner may insufficiently contribute to fixation when the peak appears at above 90° C. The endothermic peak is preferably determined by a differential scanning calorimeter of internally heated, input-compensated type, in view of the high precision derived from its working principle.

The photoreceptor for the present invention may be of an inorganic type, such as amorphous silicon or selenium, or of organic type, such as polysilane or phthalocyanine, among which an amorphous silicon photoreceptor is particularly preferable, in view of its long service life. Development may be based on a magnetic or nonmagnetic 1- or 2-component system. When a 2-component system is adopted, the carrier may be of powdered magnetite, ferrite, or iron. The carrier is preferably coated with a silicone-based material. The binder resin for the toner of the present invention preferably has a glass transition temperature (Tg) of 50 to 70° C.

The color developing toner for the present invention may be incorporated with various additives, such as binder resin, wax, an antistatic agent, pigment or dye serving as a colorant, a magnetic substance, and an infrared absorber. The toner is well mixed with these additives by use of a mixer, such as a HENSCHEL MIXER or a ball mill, and then rendered molten/kneaded by use of a kneader operating at an elevated temperature, such as a hot roller, kneader, or extruder, to thereby dissolve the resin components in each other. The toner is then incorporated with a metallic compound, pigment, dye, and/or magnetic substance, and the resultant dispersion or solution is cooled, solidified, crushed, and classified to thereby produce the toner of the present invention. In the present embodiment a master batch of a pigment or infrared absorber was not prepared, in view of cost considerations, but may be prepared beforehand.

One or more additives may be additionally incorporated into the color developing toner of the present invention, as required, and well mixed by a mixer.

In the present embodiment, toner absorbance was determined by the reflection method using a spectrophotometer (U-4100, product of Hitachi, Ltd.), where the toner was set in a quartz cell (PSH-001, measuring 3.4 cm by 2.0 cm by 4.8 cm). "Absorbance" is defined by $\log_{10}(I_o/I)$, where $I_o$ is incident light intensity and I is transmitted light intensity. Emission spectrum intensity of a flash lamp was determined by an analyzer (USR-40V, product of Ushio Inc.). "Quantity of absorbed light" means integrated absorbance over a given wavelength range. "Equivalent quantity of absorbed light" means that difference in quantities of light absorbed by two samples to be compared falls within approximately ±10%.

[Color Image Forming Developer]

The electrographic developer (color image forming developer) of the present invention containing the toner will now be described. The developer may be a one-component system consisting of the color developing toner of the present invention, or a two-component system consisting of the toner and a carrier. The developer of the present invention is described while a two-component system is taken as an example.

No particular limitation is imposed on the carrier of the two-component system, which may include any carrier that is commonly used. For example, the carrier may be a resin-coated carrier comprising a core coated with a resin layer. Moreover, the carrier may be a resin-dispersed carrier comprising a matrix resin in which an electroconductive material is dispersed.

Examples of the coating and matrix resins for the carrier include, but are not limited to, polyethylene, polypropylene, polystyrene, polyvinyl acetate, polyvinyl alcohol, polyvinyl butyral, polyvinyl chloride, polyvinyl ether, polyvinyl ketone, vinyl chloride/vinyl acetate copolymer, styrene/acrylic acid copolymer, straight silicone resin consisting of organosiloxane bond or a modification thereof, fluorine resin, polyester, polycarbonate, phenolic resin, and epoxy resin.

Examples of electroconductive materials for the carrier include, but are not limited to, metals such as gold, silver, and copper; carbon black; titanium oxide; zinc oxide; barium sulfate; aluminum borate; potassium titanate; and tin oxide.

Examples of carrier core materials include magnetic metals such as iron, nickel, and cobalt; magnetic oxides such as ferrite and magnetite; and glass beads. When the carrier is used for magnetic brushing, the core is preferably of a magnetic material. The carrier core generally has a volume-average particle size of 10 to 500 μm, preferably 30 to 100 μm.

The carrier core is coated with a resin, which may be dissolved in a suitable solvent together with one or more additives, as required. No particular limitation is imposed on the solvent, which may be suitably selected in consideration of a coating resin to be used, its coatability, and the like. No particular limitation is imposed on the coating resin, but silicone resin is preferably used.

Methods for coating the carrier core with a resin include dipping, in which the core is immersed in a coating solution; spraying, in which a coating solution is sprayed onto the core; a fluidized bed method, in which a coating solution is sprayed onto the core while the core is fluidized by air; and a kneader/coater method, in which the carrier core is mixed with a coating solution and the solvent is subsequently removed.

The color developing toner/carrier mixing ratio for the two-component developer of the present invention is approximately 1/100 to 30/100 by weight, preferably 3/100 to 20/100.

[Color Image Forming Method and Color Image Forming Device]

The color image forming method of the present invention will now be described. No particular limitation is imposed on the method, so long as it employs the developer containing at least the color developing toner described above. A preferable method is specifically described below.

The color image forming method of the present invention comprises a step for forming an electrostatic latent image on a surface of an electrostatic latent image holding member, a step for developing the image with a toner-containing developer to thereby form the toner image, a step for transferring the toner image formed on the electrostatic latent image holding member onto a surface of a transferring material, and a step for fixing the toner image transferred on the transferring material onto a surface of a recording medium, wherein the developing step must employ the developer of the present invention containing a magenta toner. The developer generally contains other color toners, such as cyan, yellow, and black toners.

Each of the above steps may be carried out by a known method traditionally used for image forming. In the case where no intermediate medium or the like is used, the medium will directly serve as a recording medium. The image forming method of the present invention may include one or more additional steps, such as a cleaning step for cleaning the carrier surface on which the latent image is formed.

FIG. 1 illustrates one example of an image forming device which can carry out the above steps. The device can form an image in the following manner, while using an electrophotographic photoreceptor as the electrostatic latent image holding member. First, the electrophotographic photoreceptor surface is uniformly charged by a corotron, contact charger, or the like, and then the surface is exposed to form an electrostatic latent image thereon. Next, a developing roller coated with a developer layer is brought into contact with, or in proximity to, the electrostatic latent image to thereby deposit toner particles, so as to form the toner image on the photoreceptor. The toner image is transferred to a recording medium, such as paper, by means of a corotron. The transferred toner image is fixed by a fuser to thereby form the image on the recording medium.

The photoreceptor for the present invention may be of an inorganic type; e.g., of amorphous silicon or selenium, or of an organic type; e.g., of polysilane or phthalocyanine used as a charge-generating or charge-transferring material, of which an amorphous silicon photoreceptor is particularly preferred, in view of its long service life.

When 4-color toner consisting of cyan, yellow, and black toners for flash fusing, including an infrared absorber, in addition to the magenta toner of the present invention, is used for forming an image, the fixation may be carried out every time one of the toners is transferred onto a recording medium, or at one time after the images of all of the 4 color toners are laminated on a recording medium.

Light energy (fixation energy) for flash fusing is preferably 1 to 7 J/cm$^2$, more preferably 2 to 5 J/cm$^2$. When fixation is carried out every time one of the toners is transferred onto the recording medium (hereinafter sometimes referred to as "monochromic fixation"), the light energy is preferably 1 to 3

J/cm$^2$ or thereabouts. When flash fusing is carried out at one time after the images of all the 4 color toners are laminated onto the recording medium (hereinafter sometimes referred to as "4-color, lump flash fusing"), the light energy is preferably 2 to 7 J/cm$^2$ or thereabouts, more preferably 3 to 5 J/cm$^2$. The device illustrated in FIG. 1 is for "4-color, lump flash fusing."

Fixation may fail to be carried out satisfactorily when fixation energy falls below 1 J/cm$^2$ for monochromic fixation, or below 2 J/cm$^2$ for 4-color, lump flash fusing. Meanwhile, when fixation energy falls above 3 J/cm$^2$ for monochromic fixation or above 7 J/cm$^2$ for 4-color, lump flash fusing, problems may occur, such as formation of toner voids or baking of recording medium.

As a flash-fusing device, there may be employed a light source (lamp) which can emit infrared rays; e.g., a mercury, halogen, or xenon lamp. One or more lamps may be used in combination.

A xenon lamp is a more preferable light source, in view that it can more efficiently enhance light absorption efficiency of the infrared absorber for the present invention and secure good fixation capacity.

The toner can be efficiently fixed by fusing flash; in particular, that emitted from a xenon lamp. Emission energy per unit area of one fusing flash, which is a measure of xenon lamp intensity, is given by the following formula:

$$S=((1/2)\times C\times V^2)/(u\times L)/n\times f) \quad (3)$$

wherein, n: number of lamps used, f: frequency of light (Hz), V: input voltage (V), C: condenser capacity (μF), u: process transfer rate (mm/second), L: printing width (mm), and S: energy density (J/cm$^2$).

As described above, fixation is carried out by a flare of fusing flash every time one color of toner is transferred onto a recording medium, or at one time for all of the toners. As in the image forming device shown in FIG. 1, fixation of 4 colors at one time requires a flash energy of 2 to 7 J/cm$^2$, with a flash energy of 3 to 5 J/cm$^2$ being preferred. Fixation may fail to be carried out satisfactorily when flash energy falls below 2 J/cm$^2$, and a problem, such as formation of toner voids or baking of recording medium, may occur when flash energy falls above 7 J/cm$^2$.

Other preferred embodiments of the present invention will now be described.

Another preferred embodiment employs toner containing yellow, magenta, and cyan toners, each incorporating an infrared absorber, wherein a total quantity of infrared rays (800 to 1100 nm) and visible rays (600 to 800 nm) absorbed by the cyan toner is equivalent to that absorbed by each of the yellow and magenta toners.

Yet another preferred embodiment employs toner containing yellow, magenta, and cyan toners, each incorporating an infrared absorber, wherein a quantity of infrared rays (800 to 1100 nm) absorbed by the cyan toner is smaller than that absorbed by the yellow toner and that absorbed by the magenta toner.

When infrared absorbers contained in the respective toners for the above color image forming developer are equivalent in terms of infrared absorbing capacity, the absorber is preferably incorporated in the cyan toner at a lower content than in the yellow and magenta toners.

An infrared absorber is preferably incorporated into the respective color toners at content ratios falling within ranges defined by the following formulae (1) and (2):

$$0.3<Kc/Km<0.9 \quad (1)$$

$$0.3<Kc/Ky<0.9 \quad (2)$$

wherein,

Kc: Content of an infrared absorber in a cyan toner, in parts by weight per 100 parts by weight of the toner Km: Content of an infrared absorber in a magenta toner, in parts by weight per 100 parts by weight of the toner Ky: Content of an infrared absorber in a yellow toner, in parts by weight per 100 parts by weight of the toner.

The present invention can provide a color image forming developer which simultaneously attains sufficient fixation capacity and sufficient resistance to void formation, and a color image forming method and a color image forming device using the developer.

EXAMPLES

The present invention will now be described in more detail by references to Examples.

[Production of Toner]

A toner composition comprising 92.0 parts of a binder resin, 0.5 parts of an infrared absorber, 5 parts of a magenta pigment, 1 part of an antistatic agent, and 1 part of wax as the major ingredients, all in parts by weight, was treated by a HENSCHEL MIXER for preliminary mixing, kneaded by an extruder, coarsely crushed by a hammer mill, finely crushed by a jet mill, and classified by an air classifier to thereby prepare fine, color particles having a volume-average particle size of 6.5 μm. Fine, hydrophobic silica particles were incorporated therein in an amount of 0.5 parts by weight by means of a HENSCHEL MIXER, to thereby prepare Toner MT1.

A toner composition comprising 92.0 to 92.2 parts of a binder resin, 0 to 0.5 parts of an infrared absorber 1 (naphthalocyanine, YKR5010®, product of Yamamoto Chemicals), 0 to 0.3 parts of an infrared absorber 2 (aminium, IRG003K®, product of Nippon Kayaku), 5 parts of a yellow pigment, 1 part of an antistatic agent, and 1 part of wax as the major ingredients, all in parts by weight, was treated by a HENSCHEL MIXER for preliminary mixing, kneaded by an extruder, coarsely crushed by a hammer mill, finely crushed by a jet mill, and classified by an air classifier to thereby prepare fine, color particles having a volume-average particle size of 6.5 μm. Fine, hydrophobic silica particles were incorporated therein in an amount of 0.5 parts by weight by means of a HENSCHEL MIXER, to thereby prepare Toners YT1 to YT4.

A toner composition comprising 95 to 95.4 parts of a binder resin, 0.1 to 0.5 parts of an infrared absorber, 2 parts of a cyan pigment, 1 part of an antistatic agent, and 1 part of wax as the major ingredients, all in parts by weight, was treated by a HENSCHEL MIXER for preliminary mixing, kneaded by an extruder, coarsely crushed by a hammer mill, finely crushed by a jet mill, and classified by an air classifier to thereby prepare fine, color particles having a volume-average particle size of 6.5 μm. Fine, hydrophobic silica particles were incorporated therein in an amount of 0.5 parts by weight by means of a HENSCHEL MIXER, to thereby prepare Toners CT1 to CT5.

Table 1 gives characteristics and ingredients of the magenta, yellow, and cyan toner compositions.

TABLE 1

| | Designation | Maximum infrared absorbance in a wavelength range of 800 to 1100 nm | Content of infrared absorber 1 (% by weight) | Content of infrared absorber 2 (% by weight) | Binder resin Binder resin (parts by weight) | Antistatic agent Quarternary ammonium salt (parts by weight) | Wax 550P (parts by weight) | Pigments Cyan pigment | Pigments Magenta pigment | Pigments Yellow pigment | Additional component Silica (parts by weight) |
|---|---|---|---|---|---|---|---|---|---|---|---|
| Cyan | CT-1 | 0.25 | 0.1 | 0 | 95.4 | 1 | 1 | 2 | 0 | 0 | 0.5 |
| | CT-2 | 0.4 | 0.15 | 0 | 95.35 | 1 | 1 | 2 | 0 | 0 | 0.5 |
| | CT-3 | 0.7 | 0.25 | 0 | 95.25 | 1 | 1 | 2 | 0 | 0 | 0.5 |
| | CT-4 | 0.8 | 0.45 | 0 | 95.05 | 1 | 1 | 2 | 0 | 0 | 0.5 |
| | CT-5 | 0.817 | 0.5 | 0 | 95 | 1 | 1 | 2 | 0 | 0 | 0.5 |
| Magenta | MT-1 | 0.817 | 0.5 | 0 | 92 | 1 | 1 | 0 | 5 | 0 | 0.5 |
| Yellow | YT-1 | 0.76 | 0.3 | 0 | 92.2 | 1 | 1 | 0 | 0 | 5 | 0.5 |
| | YT-2 | 0.819 | 0.5 | 0 | 92 | 1 | 1 | 0 | 0 | 5 | 0.5 |
| | YT-3 | 0.75 | 0 | 0.3 | 92.2 | 1 | 1 | 0 | 0 | 5 | 0.5 |
| | YT-4 | 0.72 | 0.15 | 0.15 | 92.2 | 1 | 1 | 0 | 0 | 5 | 0.5 |

In Table 1:

Infrared absorber 1: Naphthalocyanine (YKR5010®, product of Yamamoto Kasei)

Infrared absorber 2: Aminium (IRG003k®, product of Nippon Kayaku)

[Flash Printer Printing Test-Evaluation]

The color toners in EXAMPLES 1 to 10, COMPARATIVE EXAMPLES 1 to 7 and REFERENCE EXAMPLE 8 were prepared by varying infrared absorber content, while binder content was adjusted in accordance with infrared absorber content to yield a composition wherein the binder+infrared absorber(s)+pigments+antistatic agent+wax=100. Table 2 provides the toner compositions prepared in EXAMPLES, COMPARATIVE EXAMPLES and REFERENCE EXAMPLE 8. Table 3 provides the results of evaluation of these toners for fixation capacity and the like as determined by the flash printer printing test.

Commercial Products Used

Binder resin: polyester (FP118, product of Kao Corp.)

Magenta pigment: Pigment violet 19 (HOSTAPERM RED E2B70, product of Clariant)

Cyan pigment: Pigment Blue 15:3 (BLUE NO. 4, product of Dainichiseika Color & Chemicals Mfg.)

Yellow pigment: Pigment Yellow 185 (PALIOTOL Y-D 1155, product of BASF)

Infrared Absorber: Naphthalocyanine ( YKR5010®, product of Yamamoto Chemicals)

Antistatic agent: Quaternary ammonium salt (P-51, product of Orient Chemical Industries)

Wax: Polypropylene (550P, product of Sanyo Chemical Industries)

Additional component: Silica (TG820F, product of Cabot Corp.)

TABLE 2

| | Toners Cyan | Toners Magenta | Toners Yellow | Infrared absorber content (% by weight) Cyan toner | Infrared absorber content (% by weight) Magenta toner | Infrared absorber content (% by weight) Yellow toner |
|---|---|---|---|---|---|---|
| EXAMPLE 1 | CT-2 | MT-1 | YT-2 | 0.15 | 0.5 | 0.5 |
| EXAMPLE 2 | CT-3 | MT-1 | YT-2 | 0.25 | 0.5 | 0.5 |
| EXAMPLE 3 | CT-4 | MT-1 | YT-2 | 0.45 | 0.5 | 0.5 |
| EXAMPLE 4 | CT-3 | MT-1 | YT-1 | 0.25 | 0.5 | 0.3 |
| EXAMPLE 5 | CT-3 | MT-1 | YT-3 | 0.25 | 0.5 | 0.3 |
| EXAMPLE 6 | CT-3 | MT-1 | YT-4 | 0.25 | 0.5 | 0.3 |
| EXAMPLE 7 | CT-2 | MT-1 | YT-2 | 0.15 | 0.5 | 0.5 |
| EXAMPLE 8 | CT-2 | MT-1 | YT-2 | 0.15 | 0.5 | 0.5 |
| EXAMPLE 9 | CT-4 | MT-1 | YT-2 | 0.45 | 0.5 | 0.5 |
| EXAMPLE 10 | CT-4 | MT-1 | YT-2 | 0.45 | 0.5 | 0.5 |
| COMPARATIVE EXAMPLE 1 | CT-5 | MT-1 | YT-2 | 0.5 | 0.5 | 0.5 |
| COMPARATIVE EXAMPLE 2 | CT-5 | MT-1 | YT-2 | 0.5 | 0.5 | 0.5 |
| COMPARATIVE EXAMPLE 3 | CT-5 | MT-1 | YT-2 | 0.5 | 0.5 | 0.5 |
| COMPARATIVE EXAMPLE 4 | CT-5 | MT-1 | YT-2 | 0.5 | 0.5 | 0.5 |
| COMPARATIVE EXAMPLE 5 | CT-5 | MT-1 | YT-2 | 0.5 | 0.5 | 0.5 |
| COMPARATIVE EXAMPLE 6 | CT-5 | MT-1 | YT-2 | 0.5 | 0.5 | 0.5 |

TABLE 2-continued

| | Toners | | | Infrared absorber content (% by weight) | | |
|---|---|---|---|---|---|---|
| | Cyan | Magenta | Yellow | Cyan toner | Magenta toner | Yellow toner |
| COMPARATIVE EXAMPLE 7 | CT-5 | MT-1 | YT-2 | 0.5 | 0.5 | 0.5 |
| REFERENCE EXAMPLE 8 | CT-1 | MT-1 | YT-2 | 0.1 | 0.5 | 0.5 |

TABLE 3

| | Kc/Km | Kc/Ky | Flash fixation energy (J/cm$^2$) | Fixation rate (%) Quantity of deposited toner (total of 3 colors, mg/cm$^2$) | Evaluation of fixation capacity | Evaluation of resistance to void formation | Color repeatability Cyan | Magenta | Yellow |
|---|---|---|---|---|---|---|---|---|---|
| EXAMPLE 1 | 0.3 | 0.3 | 4 | 86 | Good | Good | Excellent | Excellent | Good |
| EXAMPLE 2 | 0.5 | 0.5 | 4 | 90 | Excellent | Good | Excellent | Excellent | Good |
| EXAMPLE 3 | 0.9 | 0.9 | 4 | 95 | Excellent | Good | Good | Excellent | Good |
| EXAMPLE 4 | 0.5 | 0.8 | 4 | 90 | Excellent | Good | Excellent | Excellent | Good |
| EXAMPLE 5 | 0.5 | 0.8 | 4 | 85 | Good | Good | Excellent | Excellent | Good |
| EXAMPLE 6 | 0.5 | 0.8 | 4 | 95 | Excellent | Good | Excellent | Excellent | Excellent |
| EXAMPLE 7 | 0.3 | 0.3 | 2 | 80 | Good | Good | Excellent | Excellent | Good |
| EXAMPLE 8 | 0.3 | 0.3 | 7 | 99 | Excellent | Good | Excellent | Excellent | Good |
| EXAMPLE 9 | 0.9 | 0.9 | 2 | 85 | Good | Good | Good | Excellent | Good |
| EXAMPLE 10 | 0.9 | 0.9 | 7 | 100 | Excellent | Good | Good | Excellent | Good |
| COMPARATIVE EXAMPLE 1 | 1 | 1 | 4 | 98 | Excellent | Poor | Good | Excellent | Good |
| COMPARATIVE EXAMPLE 2 | 1 | 1 | 2 | 55 | Poor | Good | Good | Excellent | Good |
| COMPARATIVE EXAMPLE 3 | 1 | 1 | 2.5 | 65 | Poor | Good | Good | Excellent | Good |
| COMPARATIVE EXAMPLE 4 | 1 | 1 | 3 | 70 | Poor | Good | Good | Excellent | Good |
| COMPARATIVE EXAMPLE 5 | 1 | 1 | 3.5 | 75 | Poor | Poor | Good | Excellent | Good |
| COMPARATIVE EXAMPLE 6 | 1 | 1 | 6 | 90 | Excellent | Poor | Good | Excellent | Good |
| COMPARATIVE EXAMPLE 7 | 1 | 1 | 7 | 100 | Excellent | Poor | Good | Excellent | Good |
| REFERENCE EXAMPLE 8 | 0.2 | 0.2 | 4 | 70 | Poor | Good | Good | Excellent | Good |

Next, a 1-inch square (2.54 by 2.54 cm) image was formed on common paper (NIP-1500LT, product of Kobayashi Kirokushi) serving as a recording medium, by means of an image forming device capable of flash fusing, where a deposited color quantity was set within the range of 0.65 to 0.75 mg/cm$^2$ for each color and to 1.9 to 2.1 mg/cm$^2$ for the total of yellow, magenta, and cyan toners. Each image was fixed by the 4-color, lump flash fusing method using the device illustrated in FIG. 1, for evaluation of its characteristics.

The image forming device used for the test was a modification of a commercial printer (CF1100, product of Fuji Xerox) equipped with a xenon flash lamp having a high emission intensity in a wavelength range of 700 to 1500 nm serving as the flash-fusing device, as described in the embodiments (see FIG. 1).

<Evaluation of Fixation Capacity>

The 1-inch square image produced in the above-described manner was evaluated for its fixation rate. First, the image was analyzed for its Status A concentration (OD1). Next, an adhesive tape (SCOTCH MENDING TAPE, product of Sumitomo 3M) was placed on the image and then removed, in order to measure Status A concentration (OD2) of the image. The optical concentration was determined by an analyzer (X RITE938). Fixation rate was determined by the following Formula (4), from the optical concentration.

$$\text{Fixation rate}=(OD2/OD1)\times 100 \quad (4)$$

Visual observation confirmed that the produced image was of high quality, having few defects; e.g., fogging, in the backdrop. Fixation capacity was evaluated according to the following standards, based on the fixation rate determined by Formula (4):

Excellent: 90% or more

Good: 80 to 89%

Poor: 79% or less (unacceptable for practical purposes)

<Evaluation of Voids>

Similarly, the 1-inch square image on which the 3 colors had been deposited to a total quantity of 1.9 to 2.1 mg/cm$^2$ was microscopically observed so as to investigate the sizes and numbers of voids.

Figure 2:
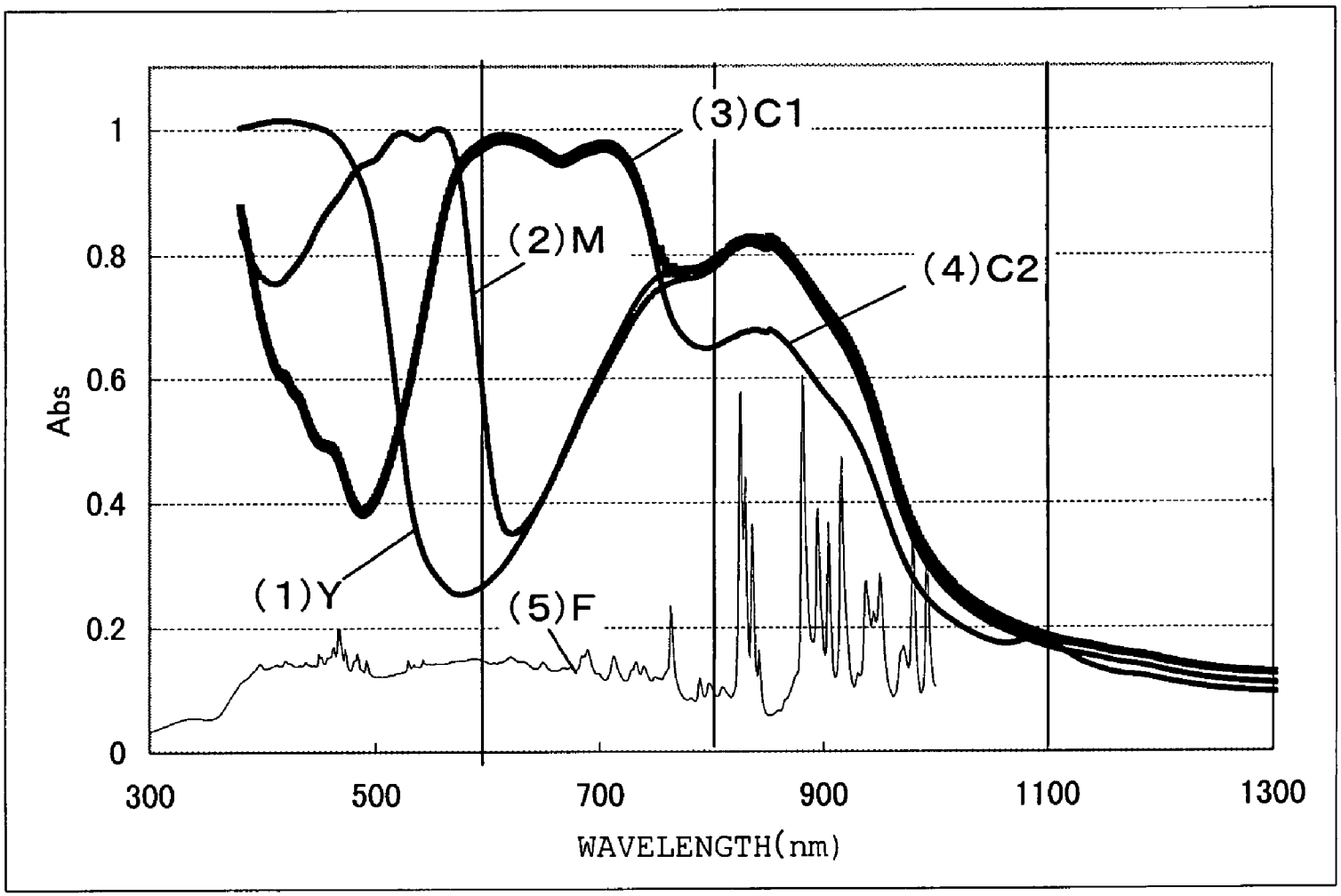
FIG. 2 shows an absorption spectral pattern for each color toner used in the embodiment.

Good: Free of voids, or 10 to 50 voids each measuring several tens of micron meters, as counted under careful visual observation Poor: including voids measuring several hundreds of micron meters, clearly discernible by visual observation, or NG level FIG. 2 shows the light absorption waveforms, produced with the infrared absorbers incorporated in an amount of 0.5% by weight into each of the cyan, magenta, and yellow toners, and in an amount of 0.25% by weight only in the cyan toner, where (1)Y, (2)M, and (3)C1 denote the yellow, magenta, and cyan toners incorporating the infrared absorber in an amount of 0.5% by weight, respectively; (4)C2 denotes the cyan toner incorporating the infrared absorber in an amount of 0.25% by weight; and (5)F denotes an emission spectral pattern of the employed flash lamp. As shown, (3)C1 and (4)C2 absorbed more visible light (600 to 800 nm) than did each of (1)Y and (2)M. The figure also shows that (4)C2, the cyan toner incorporating the infrared absorber in an amount of 0.25% by weight; i.e., half of the content for (3)C1, absorbed less infrared radiation (800 to 1100 nm) and had a maximum absorbance lower than that of (3)C1.

The cyan toner incorporating the infrared absorber at a lower content of 0.25% by weight exhibited fixation capacity equivalent to those of the magenta and yellow toners, despite being lower in absorption of infrared radiation (800 to 1100 nm), conceivably resulting from thermal conversion of the visible light absorbed by the cyan pigment.

The present invention is applicable to a photo-fixed color image forming developer, a color image forming method, and a color image forming device.

The description of Japanese Patent Application No. 2004-81359 filed on Mar. 19, 2004, including the specification, claims, drawings, and abstract, is incorporated herein by reference in its entirety.

What is claimed is:

1. A color image forming developer comprising yellow, magenta, and cyan toners, said yellow, magenta, and cyan toners containing an infrared absorber, wherein the cyan toner has a maximum infrared absorbance lower than a maximum infrared absorbance of the magenta toner and a maximum infrared absorbance of the yellow toner, said maximum infrared absorbance is determined in a wavelength range of from 800 to 1100 nm, wherein the infrared absorber incorporated into the cyan, magenta, and yellow toners at the following content ratios as represented by the following formulae (1) and (2):

$$0.3<Kc/Km<0.5 \quad (1)$$

$$0.3<Kc/Ky<0.5 \quad (2)$$

wherein,

Kc: Content of an infrared absorber in the cyan toner, in parts by weight per 100 parts by weight of the cyan toner, Km: Content of an infrared absorber in the magenta toner, in parts by weight per 100 parts by weight of the magenta toner, and Ky: Content of an infrared absorber in the yellow toner, in parts by weight per 100 parts by weight of the yellow toner.

2. The color image forming developer according to claim 1, wherein Kc ranges from 0.05 to 5, Km and Ky range from 0.1 to 5.

3. The color image forming developer according to claim 1, wherein Kc ranges from 0.1 to 2, Km and Ky range from 0.2 to 2.

4. The color image forming developer according to claim 1, wherein Kc ranges from 0.15 to 0.5, Km and Ky range from 0.4 to 1.

5. The color image forming developer according to claim 1, wherein the infrared absorber is selected from the group consisting of a naphthalocyanine derivative, an aminium compound, and a diimonium compound.

6. The color image forming developer according to claim 1, wherein the infrared absorber is used in combination, said combination selected from the group consisting of a naphthalocyanine derivative, an aminium compound and a diimonium compound.

* * * * *